US010116110B2

(12) United States Patent
Woletz et al.

(10) Patent No.: US 10,116,110 B2
(45) Date of Patent: Oct. 30, 2018

(54) ROTOR ARRANGEMENT FOR A SLIP RING ASSEMBLY AND ROTARY COUPLING ARRANGEMENT COMPRISING A ROTOR ARRANGEMENT OF THIS KIND

(71) Applicant: CARL ZEISS INDUSTRIELLE MESSTECHNIK GMBH, Oberkochen (DE)

(72) Inventors: Tobias Woletz, Essingen (DE); Dieter Kaufmann, Heidenheim (DE)

(73) Assignee: CARL ZEISS INDUSTRIELLE MESSTECHNIK GMBH, Oberkochen (DE)

( * ) Notice: Subject to any disclaimer, the term of this patent is extended or adjusted under 35 U.S.C. 154(b) by 0 days.

(21) Appl. No.: 15/610,723

(22) Filed: Jun. 1, 2017

(65) Prior Publication Data

US 2017/0271833 A1 Sep. 21, 2017

Related U.S. Application Data

(63) Continuation of application No. PCT/EP2015/078699, filed on Dec. 4, 2015.

(30) Foreign Application Priority Data

Dec. 10, 2014 (DE) ..... 10 2014 118 359

(51) Int. Cl.
*H01R 13/639* (2006.01)
*H01R 39/34* (2006.01)
*H01R 39/14* (2006.01)

(52) U.S. Cl.
CPC ..... *H01R 39/34* (2013.01); *H01R 39/14* (2013.01)

(58) Field of Classification Search
CPC ..... H01R 39/14; H01R 39/34; H02K 17/02
See application file for complete search history.

(56) References Cited

U.S. PATENT DOCUMENTS 2,766,625 A 10/1956 Swanson
3,601,474 A 8/1971 Prall et al.
(Continued)

FOREIGN PATENT DOCUMENTS

DE 1 036 371 1/1959
DE 30 19 118 C2 11/1981
(Continued)

OTHER PUBLICATIONS

English translation of International Preliminary Report on Patentability for PCT/EP2015/078699; dated Jun. 15, 2017; 9 pp.
(Continued)

*Primary Examiner* — Briggitte R Hammond
(74) *Attorney, Agent, or Firm* — Harness, Dickey & Pierce, P.L.C.

(57) ABSTRACT

A rotor arrangement for a slip ring assembly, comprising a shaft element and at least one contact ring. The shaft element is at least partially in the form of a hollow shaft with a hollow interior and a casing wall. The shaft element has a middle section and each contact ring is arranged on the shaft element in the middle section and is electrically insulated from the shaft element by means of an insulation. The middle section has at least one cutout through the insulation and the casing wall into the interior. Each contact ring is connected to a cable element which is guided through one of the at least one cutout into the interior. The shaft element has a first end section with an outer circumferential cross section for the rotationally fixed coupling. Furthermore, a rotary coupling arrangement comprising a rotor arrangement of this kind is proposed.

18 Claims, 4 Drawing Sheets

(56) References Cited

U.S. PATENT DOCUMENTS

| | | | |
|---|---|---|---|
| 4,491,787 | A | 1/1985 | Akiyama et al. |
| 5,124,608 | A | 6/1992 | Lawrence et al. |
| 2003/0085681 | A1 | 5/2003 | Sakamoto et al. |
| 2011/0088481 | A1 | 4/2011 | Dahlem et al. |

FOREIGN PATENT DOCUMENTS

| | | | |
|---|---|---|---|
| DE | 31 33 477 | C2 | 4/1982 |
| DE | 249 523 | A1 | 9/1987 |
| DE | G 91 16 310.2 | | 9/1992 |
| DE | 295 19 611 | U1 | 4/1996 |
| DE | 199 35 282 | A1 | 2/2001 |
| DE | 201 10 415 | U1 | 11/2001 |
| DE | 100 52 360 | A1 | 5/2002 |
| DE | 601 08 858 | T2 | 4/2006 |
| DE | 603 18 396 | T2 | 5/2008 |
| DE | 10 2008 028 403 | A1 | 12/2009 |
| DE | 20 2009 017 928 | U1 | 9/2010 |
| DE | 10 2009 057 609 | A1 | 6/2011 |
| EP | 2 451 028 | A2 | 5/2012 |
| GB | 748480 | | 5/1956 |
| GB | 2 078 017 | A | 12/1981 |
| JP | 2001-189183 | | 7/2001 |
| JP | 2010-232138 | | 10/2010 |
| WO | 03/069266 | A2 | 8/2003 |

OTHER PUBLICATIONS

German language Examination Report (with English language translation); dated Oct. 26, 2015; 16 pp.
International Search Report; dated Mar. 10, 2016; 12 pp.

ROTOR ARRANGEMENT FOR A SLIP RING ASSEMBLY AND ROTARY COUPLING ARRANGEMENT COMPRISING A ROTOR ARRANGEMENT OF THIS KIND

CROSS-REFERENCE TO RELATED APPLICATIONS

This application is a continuation of International patent application PCT/EP/2015/078699, filed Dec. 4, 2015, which claims priority of German patent application DE 10 2014 118 359.2, filed Dec. 10, 2014. The entire content of both applications is herewith incorporated by reference.

BACKGROUND OF THE INVENTION

The present invention relates to a rotor arrangement for a slip ring assembly. Furthermore, the present invention relates to a rotary coupling arrangement comprising a slip ring assembly.

In the prior art, in particular in the field of coordinate measuring technology, it is customary to fit the sensors used to support structures which allow the sensors to move freely within a measurement area. The support structures are known in various forms, for example in the form of gantry constructions or else horizontal arm constructions. The support structures often have rotation axes which allow an arrangement, for example the sensor or else, for example, an intermediate rotary pivot joint, to rotate through up to 360°. Furthermore, fully freely rotatable rotation axes are used, in the case of which rotary movements can be performed through 360° several times. In addition to relatively large measurement areas, sensors of this kind are often also used in relatively small versions in the field of coordinate measuring technology, for example when bores or material features which are difficult to access need to be measured. In general, compact constructions of the support structures and of the rotation axes used are also desired in order that the support structure itself takes up as little measurement space as possible.

Various measuring systems, both of a tactile type and of an optical type, are known in the field of coordinate measuring technology. Furthermore, a distinction is made between measuring systems which sample individual points and those measuring devices which operate with so-called "scanning methods". In scanning methods of this kind, —tactile or optical—sampling of a workpiece involves a particular path being followed on the workplace and a large number of measurement points being recorded along the path. It goes without saying that it is imperative, in particular in the case of scanning methods of this kind, for the position of the rotation axes and therefore of the measuring system to be able to be determined with a high degree of accuracy in order to be able to assign the corresponding exact spatial coordinates to the detected measurement points.

The use of slip ring assemblies is necessary in particular in the case of rotation axes or rotary joints which are intended to transmit rotary movements of 360° several times, so-called n×360 movements. Depending on the installation space available, it may also be the case here that a rotary movement beyond the slip ring assembly has to be transmitted starting from the sensor used to a measuring system for the rotary position. Problems in respect of hysteresis may occur in this case. However, hysteresis-free rotary movement and detection by a rotation position measuring system is absolutely essential, in particular in the field of coordinate measuring technology. Known slip rings are generally produced from plastic by injection molding. In the process, the contact rings used and the associated cables are encapsulated with plastic, wherein the plastic then provides the required insulation between the individual contact rings and cables and at the same time provides the shaft body of a rotor element of a slip ring assembly. However, a very large number of electrical contacts are currently required for modern sensors. If the number of cable elements to be provided is high in comparison to the installation space available, the problem may arise that a large portion of the shaft diameter available is taken up by the electrical cables themselves. As a result, only very little installation space which can be filled with plastic by injection molding remains, this leading to a very low torsional stiffness of the rotor shaft of the slip ring assembly. This can lead to twisting and even deformation of the slip ring rotor, and this may cause undesired problems in respect of hysteresis.

In particular in the case of highly accurate scannable rotation axes, in particular in the field of coordinate measuring technology, these problems can occur when transmission of the rotary movement beyond the slip ring assembly to a measuring system is required for structural or installation space reasons.

Although measuring systems for the rotation position generally have a dedicated bearing, they still have a certain resistance torque on the rotor of a slip ring assembly or on the entire rotation shaft which is coupled thereto. This also always causes corresponding twisting of the slip ring rotor given insufficient stiffness of the slip ring rotor, and this ultimately leads to the undesired hysteresis phenomena.

Although solutions without slip rings would avoid the undesired hysteresis phenomena, they generally do not allow the ability to rotate freely through rotation angles of more than 360°. Commercially available slip rings do allow rotary movements of more than 360° but the required torsional stiffness is not provided.

Corresponding problems to those in the case of coordinate measuring devices can also arise, for example, in the case of rotary tables or generally in the case of rotation axes or rotary joints in other applications which require compact designs and/or a low weight or moment of inertia.

Document DE 199 35 282 A1 describes a device for measuring a rotation angle, in which device the use of a slip ring is envisaged. Document DE 20 2009 017 928 U1 and document DE 10 2009 057 609 A1 describe a portable height gauge and scriber which likewise proposes a slip ring arrangement and the use of slip rings. Document DE 601 08 858 T2 describes a distance measuring means or a curve length measuring device in which an electrical coupling means can be formed by one or more slip rings and one or more brushes.

Document DE 201 10 415 U1 describes a checking apparatus for the measurement and/or dimensional tolerances of a rotationally symmetrical area of a workpiece, in which checking apparatus a feed and signal transmission device can be formed from one slip ring. Document DE 10 2008 028 403 A1 describes a displacement pickup for measuring the change in length of a sample, in which displacement pickup a friction coupling can be designed in the form of an adjustable spring/slip ring system. Document DE 31 33 477 C2 describes an apparatus for measuring the surface planarity of a plate. Document DD 249 523 A1 describes an apparatus for determining faults and marking faults in the case of non-conductive layers on electrically conductive material, which apparatus has a slip ring arrangement in this case. Furthermore, document DE 100 52 360 A1 describes an apparatus for measuring bores in a workpiece, in which apparatus a line section is guided in a slip ring body. Furthermore, document DE 295 19 611 U1 describes a cable-actuated length sensor, in particular for use in telescopic extension arms, which can have a slip ring arrangement.

However, in spite of this, there is also a need to solve the problems outlined above.

One object of the present invention is therefore to specify an improved rotor arrangement for a slip ring assembly or a rotary coupling arrangement, which rotor arrangement allows the hysteresis-free transmission of a rotary movement and is suitable, in particular, for use in small installation spaces for transmitting rotary movements of more than 360°.

BRIEF SUMMARY OF THE INVENTION

According to a first aspect of the invention, there is provided a rotor arrangement for a slip ring assembly, comprising a shaft element and at least one contact ring, wherein the shaft element is at least partially in the form of a hollow shaft with a hollow interior and a casing wall, wherein the shaft element has a middle section, wherein each contact ring is arranged on the shaft element in the middle section, wherein the middle section has at least one cutout through the casing wall into the interior, wherein each contact ring is connected to a cable element which is guided through one of the at least one cutout into the interior, and wherein the shaft element has a first end section with an outer circumferential cross section for the rotationally fixed coupling.

It has been found that known slip ring assemblies are not provided with a continuous rotor shaft. Rotor elements of known slip ring assemblies are produced, for example, by the abovementioned injection molding methods, or a plurality of thin sleeves are pressed one into the other. However, this does not allow the required torsional stiffness with free transmission of a rotary movement.

Providing the rotor arrangement with a hollow shaft with a hollow interior and casing wall allows said rotor arrangement to be configured in accordance with the requirements in respect of the number of electrical contacts, in respect of the resistance torque to be experienced and in respect of the available installation space. A material with a high shear modulus, for example a steel alloy or a ceramic material, can be used for the material of the hollow shaft, which can be of integral design in particular. This provides the rotor arrangement of a slip ring assembly with a torsionally stiff shaft element. Forming an end of the shaft element with an outer circumferential cross section for the rotationally fixed coupling, in particular direct rotationally fixed coupling, allows the coupling to a driven rotor assembly of a rotary coupling arrangement and the direct transmission of the rotary movement to the rotor arrangement of the slip ring assembly. In particular, it is also possible to dispense with a dedicated bearing of the rotor arrangement within a stator of the slip ring assembly, for example by means of additional ball bearings, in this way. The proposed refinement can, for example, allow a maximum hysteresis of less than 10 arc seconds to be provided in the case of a maximum outside diameter of the rotor arrangement of at most 13 mm and at least 14 contact rings or contacts which are to be transmitted by the slip ring. In this case, an outside diameter of the contact rings can be, for example, 8 mm. Overall, a rotationally fixed and stable coupling with simple extension of the rotor assembly to form a rotation position measuring system is provided in this way.

An insulation of the contact rings from the shaft element is arranged between a casing wall of the shaft element and the contact rings. Said insulation can be in the form of a pressed plastic sleeve for example. In this way, the contact rings can be threaded onto the shaft and come to rest on the plastic sleeve. The contact rings can then be alternately arranged with, for example, insulating rings which are likewise formed from plastic, so that each contact ring is adequately insulated both from the shaft element and also from adjacent contact rings.

Within the scope of the following application, "electrically insulated" can be understood to mean that an electrical conductivity over a corresponding insulation is less than 10-8 S/m or A/Vm or 1/Ωm. Here, S represents the unit siemens, m represents the unit meter, A represents the unit ampere, V represents the unit volt and Ω represents the unit ohm.

According to a first aspect of the invention, there is provided a rotary coupling arrangement or rotary coupling interface, in particular for a coordinate measuring device, comprising a slip ring assembly comprising a rotor arrangement according to the first aspect of the invention or one of its refinements, comprising a rotatable coupling assembly which has a first end and a second end which is opposite the first end, wherein the first end has a coupling interface, and wherein the second end has a slip ring assembly interface for rotationally fixed coupling to the first end section of the rotor arrangement, and comprising a rotation position measuring system for ascertaining a rotation position of the rotor arrangement of the slip ring assembly.

The proposed rotary coupling arrangement or rotary coupling interface allows the direct transmission of the rotary movement of the rotatable coupling assembly to the rotor arrangement and therefore the slip ring assembly. In this way, the rotary movement of the coupling assembly can be transmitted without dedicated bearing of the slip ring assembly. On account of the stable coupling of the rotor assembly and the high inherent stiffness of the rotor arrangement, a positional tolerance of the runout of less than 0.02 mm can be complied with at an end of the rotor arrangement which faces the rotor assembly, even without dedicated bearing.

According to a third aspect of the invention, there is provided a rotor arrangement for a slip ring assembly, comprising a shaft element and at least one contact ring, wherein the shaft element is at least partially in the form of a hollow shaft with a hollow interior and a casing wall, wherein the shaft element has a middle section, wherein each contact ring is arranged on the shaft element in the middle section, wherein the middle section has at least one cutout through the casing wall into the interior, wherein each contact ring is connected to a cable element which is guided through one of the at least one cutout into the interior, and wherein the shaft element has a first end section with an outer circumferential cross section for the rotationally fixed coupling, wherein the middle section is offset in relation to the first end section by a flange, wherein the flange has an outside diameter which is larger than a smallest outside diameter of the first end section and larger than an outside diameter of the middle section, wherein a smallest outside diameter of the first end section is larger than an outside diameter of the middle section, wherein the outer circumferential cross section of the first end section is in the form of a profile cross section, wherein the shaft element is of integral design, and wherein the rotor arrangement has more than one contact ring, and wherein an insulating ring which electrically insulates the adjacent contact rings from one another is arranged between two adjacent contact rings in each case.

According to a fourth aspect of the invention, there is provided a rotary coupling arrangement for a coordinate measuring device, comprising a slip ring assembly comprising a rotor arrangement for a slip ring assembly, comprising a shaft element and at least one contact ring, wherein the shaft element is at least partially in the form of a hollow shaft with a hollow interior and a casing wall, wherein the shaft element has a middle section, wherein each contact ring is arranged on the shaft element in the middle section, wherein the middle section has at least one cutout through the casing wall into the interior, wherein each contact ring is connected to a cable element which is guided through one of the at least one cutout into the interior, and wherein the shaft element has a first end section with an outer circumferential cross section for the rotationally fixed coupling, wherein the shaft element has a second end section which is opposite the first end section and in which the casing wall is fully closed, and wherein the rotary coupling arrangement further comprises a rotatable coupling assembly which has a first end and a second end which is opposite the first end, wherein the first end has a coupling interface, and wherein the second end has a slip ring assembly interface for rotationally fixed coupling to the first end section of the rotor arrangement, and comprising a rotation position measuring system for ascertaining a rotation position of the rotor arrangement of the slip ring assembly, and wherein the second end section is arranged on or in the rotation position measuring system.

In one refinement of the rotor arrangement, it can be provided that the middle section is offset in relation to the first end section by a flange, wherein the flange has an outside diameter which is larger than a smallest outside diameter of the first end section and larger than an outside diameter of the middle section.

In this way, a fixed abutment for the contact rings can be provided and, in addition, a moment of inertia of the rotor arrangement can be increased.

Furthermore, it can be provided in one refinement of the rotor arrangement that a smallest diameter of the first end section is larger than a diameter of the middle section.

In this way, a large moment of inertia of the rotor arrangement can likewise be provided. In addition, a coupling moment which is introduced into the rotor arrangement by means of the first end section can be large on account of the large outside diameter.

In a further refinement of the rotor arrangement, it can be provided that the outer circumferential cross section of the first end section is in the form of a profile cross section, in particular wherein the first end section is of flattened design.

In this case, a "profile cross section" can be understood to mean any non-circular outer circumferential cross section. The profile cross section allows a rotary movement to be transmitted by means of a rotationally fixed coupling. The profile cross section can be, for example, triangular, rectangular or n-sided. Ellipsoidal profile cross sections, for example, are also possible.

In a further refinement, it can be provided that the shaft element is of integral design.

In this way, the torsional stiffness of the shaft element can be improved and hysteresis-free transmission of a rotary movement can be improved.

In a further refinement, it can be provided that the shaft element is formed from a material which has a shear modulus of greater than 75 Gigapascal (GPa), in particular wherein the material of the shaft element is a steel alloy.

In this case, 1 Pascal is 1 $N/m^2$ or 1 $kg/ms^2$. The torsional stiffness of the shaft element can also be increased in this way. In particular, steel alloys can have a large shear modulus. However, unalloyed steels, for example unalloyed tool steels, can also already have a suitable torsional stiffness or an adequately high shear modulus.

Possible alloy elements for steel include, for example, chromium, vanadium, manganese, molybdenum, nickel, tungsten and/or cobalt.

In a further refinement, it can be provided that each contact ring is electrically insulated from the shaft element by means of an insulation. The at least one cutout can then be formed through the insulation and the casing wall into the interior.

In this way, an electrical insulation can be provided between the contact rings and the shaft element, for example when the shaft element is formed from a metallic material.

In a further refinement, it can be provided that the shaft element is formed from an electrically insulating material.

In this way, an additional electrical insulation between the contact rings and the shaft element is not required. By way of example, a plastic sleeve or an electrically insulating adhesive layer can then be saved. However, nevertheless, a plastic sleeve or an electrically insulating adhesive layer can in principle be provided as additional electrical insulation.

In a further refinement, it can be provided that the shaft element is formed from a material which has a shear modulus of greater than 100 GPa, in particular wherein the material of the shaft element is a ceramic alloy. The material of the shaft element can be, for example, a silicon carbide ceramic material.

In this way, an even higher shear modulus can be provided with electrical insulation at the same time.

In a further refinement, it can be provided that the rotor arrangement has more than one contact ring, and wherein an insulating ring which electrically insulates the adjacent contact rings from one another is arranged between two adjacent contact rings in each case.

In particular, the insulating ring can here also be formed from a workpiece which has an electrical conductivity of less than 10-8 ampere per voltmeter or A/Vm. In this way, adjacent contact rings can be electrically insulated from one another in a simple manner. The contact rings and insulating rings can be alternately pushed onto the shaft element in a simple manner.

In a further refinement, it can be provided that an electrically insulating insulating ring is arranged on the middle section on the flange.

In this way, it is likewise possible in a simple manner to isolate the flange of the shaft element from the contact ring which is arranged nearest to the flange. The workpiece of the insulating ring can once again also have an electrical conductivity of less than 10-8 A/Vm here too.

In a further refinement, it can be provided that the insulation is in the form of a sleeve which is composed of an electrically insulating material and which is arranged on the middle section of the shaft element.

In this way, the insulation between the contact rings and the shaft element in the radial direction can be provided in a particularly simple manner. The contact rings can be pushed onto the sleeve in a simple manner. In particular, the sleeve can be produced from a plastic. In particular, the sleeve can then be pressed onto the shaft element or the middle section of the shaft element.

In particular, the advantage becomes clear that the insulation and the supporting structure or the shaft element are separated from one another in the case of the proposed rotor arrangement. Here, the shaft element serves solely for the torsionally stiff transmission of the rotary movement, so that hysteresis-free measurement of the rotation position is possible. The contact rings are then insulated, for example, by means of the proposed sleeve or else, as will be explained below, by an adhesive layer and by insulating rings which are correspondingly likewise pushed on.

In a further refinement of the present invention, it can be provided that the insulation is in the form of an adhesive layer, wherein the adhesive layer is provided by means of an adhesive which is composed of an electrically insulating material. In this case, the adhesive layer can have a thickness of at least 0.1 mm.

An adhesive layer of this kind can also allow, for example, the contact rings to be secured on the shaft element adjacent to one another in the longitudinal direction in such a way that there is an air gap between adjacent contact rings. Insulating rings can then be left out for example. A minimum thickness of at least 0.1 mm can be provided for the adhesive layer in order to provide adequate insulation from the shaft element. In particular, a thickness of the adhesive layer of 0.15 mm can be provided. In particular, the adhesive layer can be applied to the shaft element, in particular can be applied when the shaft element is rotating. After curing, the adhesive can then be removed by turning to achieve the desired thickness. In this way, an electrical insulation can be provided in a very thin form and in a space-saving manner in direct connection with the shaft element. The contact rings can then be arranged, for example, likewise on the adhesive layer and are fixed on the adhesive layer and therefore the shaft element by means of the adhesive, in particular additional application of adhesive.

In a further refinement, it can be provided that the shaft element has a second end section which is opposite the first end section and in which the casing wall is fully closed. The shaft element can be in the form of a hollow shaft throughout. However, in this case, the casing wall of the shaft element in the second end section can be fully closed and have no cutouts.

The middle section is therefore arranged between the first end section and the second end section.

The second end section serves, in particular, for coupling to a rotation position measuring system. The second end section can be hardened. In this way, it is possible to provide a shaft pin which is composed of steel or a steel alloy as the input interface for the rotation position measuring system. The second end section can then be arranged in or on the rotation position measuring system. An additional shaft pin no longer has to be provided between the slip ring assembly and the rotation position measuring system. Further hysteresis influences can therefore be avoided.

In particular, it is therefore possible to arrange a coupling assembly, a slip ring assembly and a rotation position measuring system in series along a common rotation axis and in this way provide a compact arrangement which takes up only a little installation space.

In one refinement, it can be provided that each contact ring is adhesively bonded onto the middle section.

In particular, it can be provided in this case that respectively adjacent contact rings are arranged on the middle section in such a way that an air gap remains between them.

In other words, respectively adjacent contact rings are arranged on the middle section at a distance from one another.

Adequate insulation can be provided between adjacent contact rings in this way. For example, a small axial length of the rotor arrangement can be provided given the same number of contact rings as a result.

In a further refinement, it can be provided that each contact ring has a radial inner face, a radial outer face and two side faces, and wherein each contact ring is connected to a cable element by way of one of its side faces.

In this way, it can be provided, for example, that the cables are laterally soldered to the contact rings. In this way, the cables can be soldered to the rings before mounting and, after the rings are threaded onto the shaft element, the cables can be individually guided through the corresponding cutout into the interior of the shaft element.

In a further refinement, it can be provided that the rotor arrangement has at least fourteen contact rings.

At least fourteen or a corresponding number of electrical contacts can be provided in this way. In particular in the case of such a high number of contacts with which conventional injection-molded rotor arrangements are not suitable, a suitable torsional stiffness can therefore be provided in spite of the high number of contacts.

In one refinement, it can be provided that the rotor arrangement has a number of cutouts which corresponds to the number of contact rings.

A dedicated cutout is then provided for each cable element in this way.

In a further refinement, it can be provided that the rotor arrangement has at least one first cutout and one second cutout, wherein the first cutout and the second cutout are formed in the middle section such that they are offset in relation to one another in the circumferential direction.

This allows a dedicated cutout to be provided for each contact ring for example, but without reducing the torsional stiffness of the shaft element owing to cutouts which are at too close a distance from one another. Distribution in the circumferential direction allows a large number of cutouts to be provided, in particular a number of cutouts which corresponds to the number of contact rings. However, it is also possible for, for example, a number of cutouts which corresponds to half the number of contact rings to be provided. In this case, two contact rings would share one cutout. Two cable elements would then be guided through one cutout.

In a refinement of the rotary coupling arrangement, it can be provided that the rotary coupling arrangement has a drive device, which is coupled to the coupling assembly, in order to turn or to drive the coupling assembly.

In this way, it is possible to achieve a high degree of actuating accuracy owing to force or introduction of torque into the coupling assembly given a correspondingly designed control loop.

In a further refinement of the rotary coupling arrangement, it can be provided that the rotor arrangement is a rotor arrangement in which the shaft element has a second end section which is opposite the first end section and in which the casing wall is fully closed, and wherein the second end section is arranged in the rotation position measuring system. Furthermore, the second end section can be arranged on the rotation position measuring system. In particular, the second end section can be arranged such that it overlaps with the rotation position measuring system in a direction along the rotation axis of the shaft element. In particular, the rotor arrangement can be mounted in an overhung position in the rotor assembly.

In this way, the rotary coupling arrangement with an arrangement of coupling assembly, slip ring assembly and rotation position measuring system "in series" is provided, wherein a direct transmission of the rotary movement into the rotation position measuring system by means of the rotor arrangement of the slip ring assembly is provided between the coupling assembly. The shaft element of the rotor arrangement of the slip ring assembly is provided continuously from the coupling assembly into the rotation position measuring system. In this way, hysteresis-free direct transmission of the rotary movement of the coupling assembly into the rotation position measuring system is possible with little installation space. Furthermore, a dedicated bearing of the rotor arrangement of the slip ring assembly can, in principle, be dispensed with on account of the direct coupling of the slip ring assembly or the rotor arrangement of the slip ring assembly to coupling assembly and the rotation position measuring system. This can prevent the introduction of additional torques and/or frictional forces and therefore additional hysteresis influences.

It is understood that the aforementioned features and those yet to be explained below may be used not only in the respectively specified combination but also in other combinations or on their own, without departing from the scope of the present invention.

BRIEF DESCRIPTION OF THE SEVERAL VIEWS OF THE DRAWING

Exemplary embodiments of the invention are shown in the drawing and will be explained in greater detail in the following description. In the figures.

DETAILED DESCRIPTION OF THE INVENTION

Figure 1:
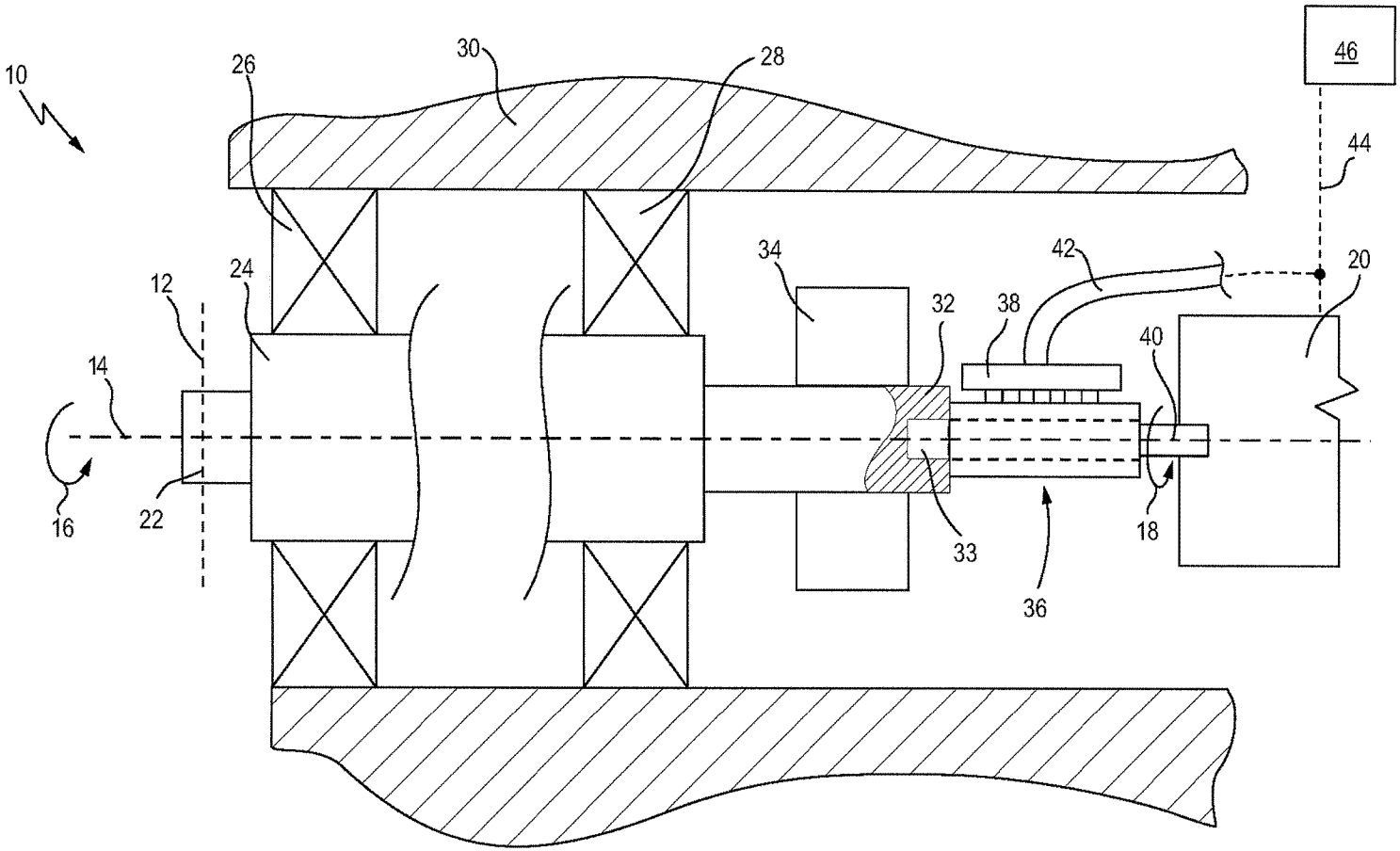
FIG. 1 shows an embodiment of a rotary coupling arrangement.

FIG. 1 shows an embodiment of a rotary coupling arrangement 10. A rotary coupling arrangement 10 of this kind can be used, in particular, in coordinate measuring devices. Said rotary coupling arrangement is used, for example, to couple a sensor to a support structure in a rotatable manner. In particular, it is possible to rotate freely through 360° several times, so-called n×360° rotatability. In this case, the dimensions of the rotary coupling arrangement can be freely selected. Furthermore, other applications are also feasible, for example in rotary tables or in other applications when rotation axes are intended to be freely pivoted through more than 360°. The use of the rotary coupling arrangement 10 in a coordinate measuring device, where it serves for coupling to a sensor, will be described in the text which follows.

To this end, the rotary coupling arrangement 10 has a sensor interface 12. A sensor can be arranged on the sensor interface 12, said sensor then being freely rotatable about a rotation axis 14. In the illustrated embodiment, the rotary coupling arrangement has to ensure in this case that a rotary movement at a sensor-side end, which rotary movement is identified by an arrow 16, is identical to a rotary movement at an opposite end, which rotary movement at the opposite end is identified by an arrow 18. Rotary movements 16 and 18 would have to be free of hysteresis and identical in order to be able to detect a rotation position of a sensor at the sensor interface 12 without hysteresis by means of a rotation position measuring system 20.

In order to achieve freedom from hysteresis, a torsionally stiff coupling has to be provided between a first end 22 of a coupling assembly 24 and the measuring system 20.

The coupling assembly 24 is mounted in a housing 30 of the rotary coupling arrangement by means of two bearings 26, 28. The housing 30 of the rotary coupling arrangement is shown merely schematically and already broken off; it can have any desired shape in principle. The coupling assembly 24 has a second end 32 opposite the first end 22 of the coupling assembly. A coupling device 33, in particular a recess, which is provided for the rotationally fixed coupling to a slip ring assembly 36, is provided in this second end 32.

The coupling assembly 24 is formed with an internal hollow space which allows electrical cable elements to be guided through from the sensor interface 12 to the slip ring assembly 36. The internal hollow space is formed along the rotation axis 14 in order to allow the cable elements to be guided through from the sensor interface 12 to the recess 33 without torsion.

A drive device 34 serves to rotate the coupling assembly 24. The drive device 34 can be formed as desired, for example an electric motor which drives the coupling assembly by means of a chain or belt drive can be provided. In particular, the drive device is intended to operate without lateral forces as far as possible. In principle, it can also be provided that the drive device is designed in the form of an electrical machine, wherein the coupling assembly is a rotor of this electrical machine.

The slip ring assembly 36 has a slip ring stator 38 and a rotor arrangement 40. The rotor arrangement 40 is described in detail below. The rotor arrangement 40 is connected to the coupling assembly 24 by way of the coupling device 33 in a rotationally fixed manner. Rotation of the coupling assembly 24, which rotation is initiated by the drive device 34, is therefore transmitted directly to the rotor arrangement 40 of the slip ring assembly 36. A stator 38 of the slip ring assembly 36 taps off the electrical signals from corresponding contacts of the rotor arrangement 40 and passes on said electrical signals by means of a corresponding cable element 42. A data transmission means 44 which can connect the cable element 42 to an evaluation and/or control device 46 is only schematically shown. The measuring system 20 can also be connected to the evaluation and/or control device 46 via this data connection 44.

The illustrated arrangement allows the coupling assembly 24, the slip ring assembly 36 and the measuring system 20 to be arranged one behind the other along the rotation axis 14. A rotary movement of the coupling assembly 24, which rotary movement is initiated by the drive device 34, is directly transmitted by means of the rotor arrangement 40 of the slip ring assembly 36. Furthermore, the rotor arrangement 40 is coupled to the measuring system 20, so that said measuring system can directly determine the rotation position. Dedicated mounting of the rotor arrangement 40 of the slip ring assembly 36 can therefore be dispensed with. Furthermore, a design of the rotary coupling arrangement 10, which design is particularly compact in respect of the diameter, is provided. It is therefore possible, for example, to provide the rotary coupling arrangement with an outside diameter of less than 20 mm, in particular less than 15 mm, in particular less than or equal to 13 mm.

Figure 2B:
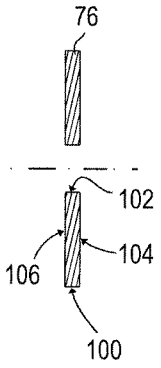
FIG. 2*b* shows a schematic cross-sectional view of a contact ring.
Figure 2A:
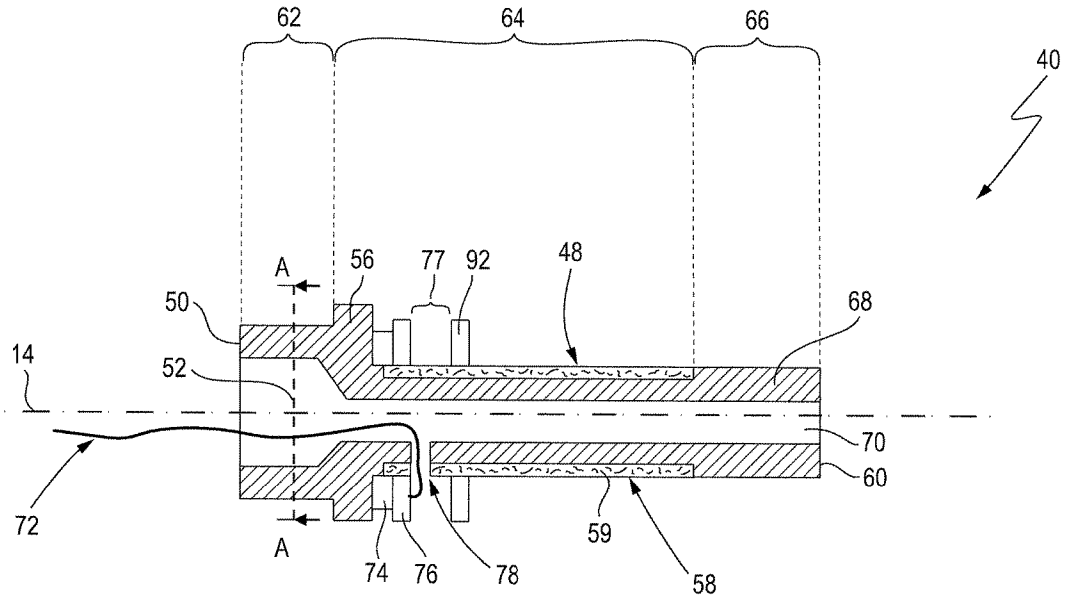
FIG. 2*a* shows an embodiment of a rotor arrangement.
Figure 2A:
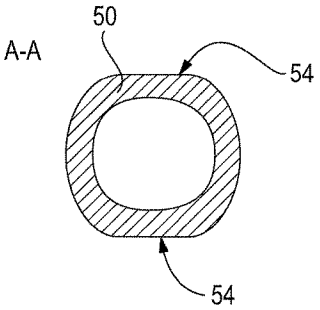

FIG. 2*a* shows a cross-sectional view of one embodiment of a rotor arrangement 40.

The rotor arrangement 40 has a shaft element 48. The shaft element 48 is at least partially in the form of a hollow shaft. In the illustrated embodiment, the shaft element 48 is in the form of a hollow shaft throughout. The shaft element 48 has a first end 50. The first end 50, as illustrated in the cross section A-A, has a profile cross section 52. This means that the profile cross section 52 is not of round design. In the illustrated embodiment, it has flattened sections 54 in order to allow rotationally fixed coupling to the coupling assembly 24. A flange 56 is formed adjacent to the flat sections 54. The flange 56 has a cross section which is larger than that of the flattened section 54. An insulation 58 adjoins the flange 56 on an outer circumference of the shaft element 48. Said insulation extends over a portion of the outer circumference of a stem of the shaft element 48. A second end 60 is situated opposite the first end 50.

At the first end 50, a first end section 62 extends into the region of the flattened sections 54 in the longitudinal direction along the rotation axis 14. Said first end section extends as far as the flange 56. A middle section 64 of the shaft element 48 extends from the flange 56 as far as an end of the insulation 58. A second end section 66 of the shaft element 48 extends from the end of the insulation as far as the second end 60. The second end section 66 can be of hardened design in particular. A casing wall of the shaft element 48 is identified by 68; a hollow interior of the shaft element 48 is identified by reference symbol 70.

In principle, the shaft element 48 can also be formed from an electrically insulating material, for example from a ceramic material. The insulation 58 can then be saved.

In the illustrated embodiment, this insulation 58 is in the form of an adhesive layer 59 which can have, in particular, a minimum thickness of 0.1 mm. Said adhesive layer can be formed, in particular, in a recessed region of the middle section 64 which has a reduced cross section in relation to the second end section 66 for example. However, in an alternative, it can also be provided that the middle section and the second end section have identical diameters, in particular outside diameters, and the insulation 58 is in the form of a sleeve, in particular which is composed of plastic, which is pressed onto the middle section.

An insulating ring 74 is arranged so as to bear against the flange 56. Said insulating ring serves to insulate a first contact 76 from the flange. Radially on the inside, the contact ring 76 is electrically insulated from the shaft element by means of the insulation 58. The axial position of said contact ring can be fixed by an additional adhesive bond on the adhesive layer 59. A further contact ring is identified by reference symbol 92. Said further contact ring is fixed on the adhesive layer 59 in such a way that there is an air gap 77 or distance 77 between the contact ring 92 and the adjacent contact ring 76. Said air gap or distance can provide a corresponding insulating effect.

FIG. 2*b* shows a schematic cross-sectional view of a contact ring 76.

The contact ring 76 has a radial inner face 102, a radial outer face 100 and two side faces 104 and 106 which are opposite one another.

A cable element 72, which is associated with the contact ring 76, is fastened to one of the side faces 104, 106; to the side face 104 in the illustrated embodiment. In particular, the cable element 72 can be soldered to the side face 104. The cable element 72 is then guided into the interior 70 through a cutout 78 which extends through the insulation 58 and the shaft element 48. From there, said cable element can exit from the first end 50 through the first end section 62 and be guided, for example, into the coupling assembly 24. In particular, it can be provided that a cutout 78 is provided for each contact ring 76, 92. However, in principle, it can be provided that a plurality of cable elements 72 are guided through a cutout 78. For example, the cable elements 72 can be provided with an insulating layer for this purpose. In this way, it is possible to thread the insulating ring 74 and the contact rings 76, 92 onto the middle section 64 from the second end 60. In a further embodiment in which the insulation 58 is formed by a plastic sleeve, it can be provided that an insulating ring 74 and a contact ring 76, 78 are alternately arranged on the middle section 64. A corresponding electrical insulation can be provided between adjacent contact rings 76, 92 in this way too.

Furthermore, it can be provided, for example, that at least the last contact ring which is pushed onto the middle section 64 is pressed on in order to provide adequate fixing in the axial direction along the rotation axis 14 of the contact rings 76, 92 and the insulating rings 74. In principle, all or a plurality of the contact rings and/or insulating rings can also be pressed on. One or more rings can be pressed on when the insulation is in the form of an adhesive layer but also if the insulation 58 is in the form of a plastic sleeve.

Figure 3:
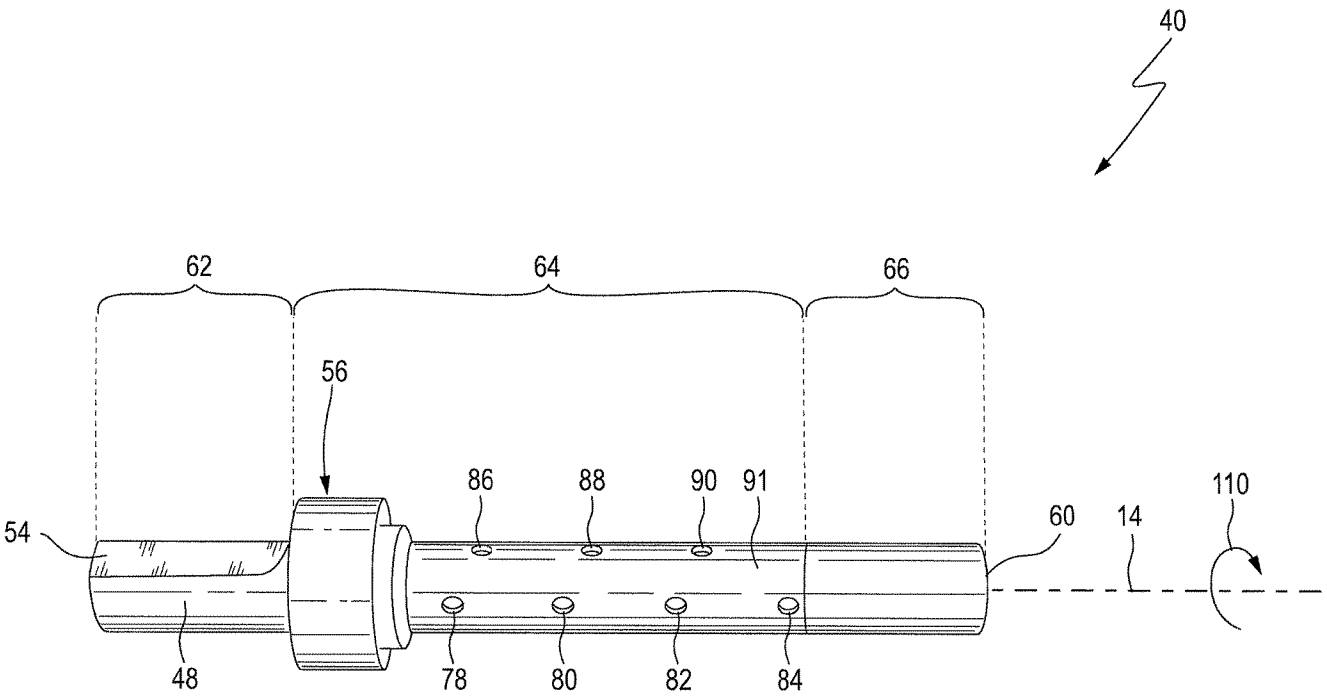
FIG. 3 shows a symmetrical view of an embodiment of a shaft element of a rotor arrangement.

FIG. 3 shows an isometric view of an embodiment of the shaft element 48. Identical elements are identified by the same reference symbols and will not be explained again below. A circumferential direction is identified by reference symbol 110. The illustrated shaft element has a total of fourteen cutouts. Seven of these cutouts are visible. Here, four cutouts 78, 80, 82, 84 are arranged in an axial row. Three further cutouts 86, 88, 90 are arranged in a further axial row. Seven further cutouts are not shown in this perspective. Here, two cutouts are arranged between cutout 86 and cutout 80 in the axial direction. Two cutouts are arranged between the cutouts 88 and 82. Two further cutouts are arranged between the cutouts 90 and 84. A further cutout is arranged between the cutout 78 and the flange. Furthermore, all of the cutouts are arranged offset in relation to one another in circumferential direction 110. This allows stability and therefore torsional stiffness of the shaft element 48 to be retained. The shaft element 48 is produced, in particular, from a steel alloy or from a ceramic material. In particular, the shaft element 48 is integrally produced. A plastic sleeve element is pushed onto the middle section 64. The cutouts 78 to 90 each extend through the sleeve element 91 and the shaft element 48. The shaft element 48 has a total of four axial rows of cutouts. The rows are offset in relation to one another in the circumferential direction 110. The cutouts are likewise offset in the axial direction along the rotation axis 14. Therefore, one cutout, through which a corresponding cable element 72 can be guided, can be provided for each of fourteen contact rings in this way, The second end section 66 does not have any cutouts. Here, the casing surface is of closed design over its entire circumference. The second end section 66 can be of hardened design. However, the entire shaft element 48 can be of hardened design overall.

Figure 4:
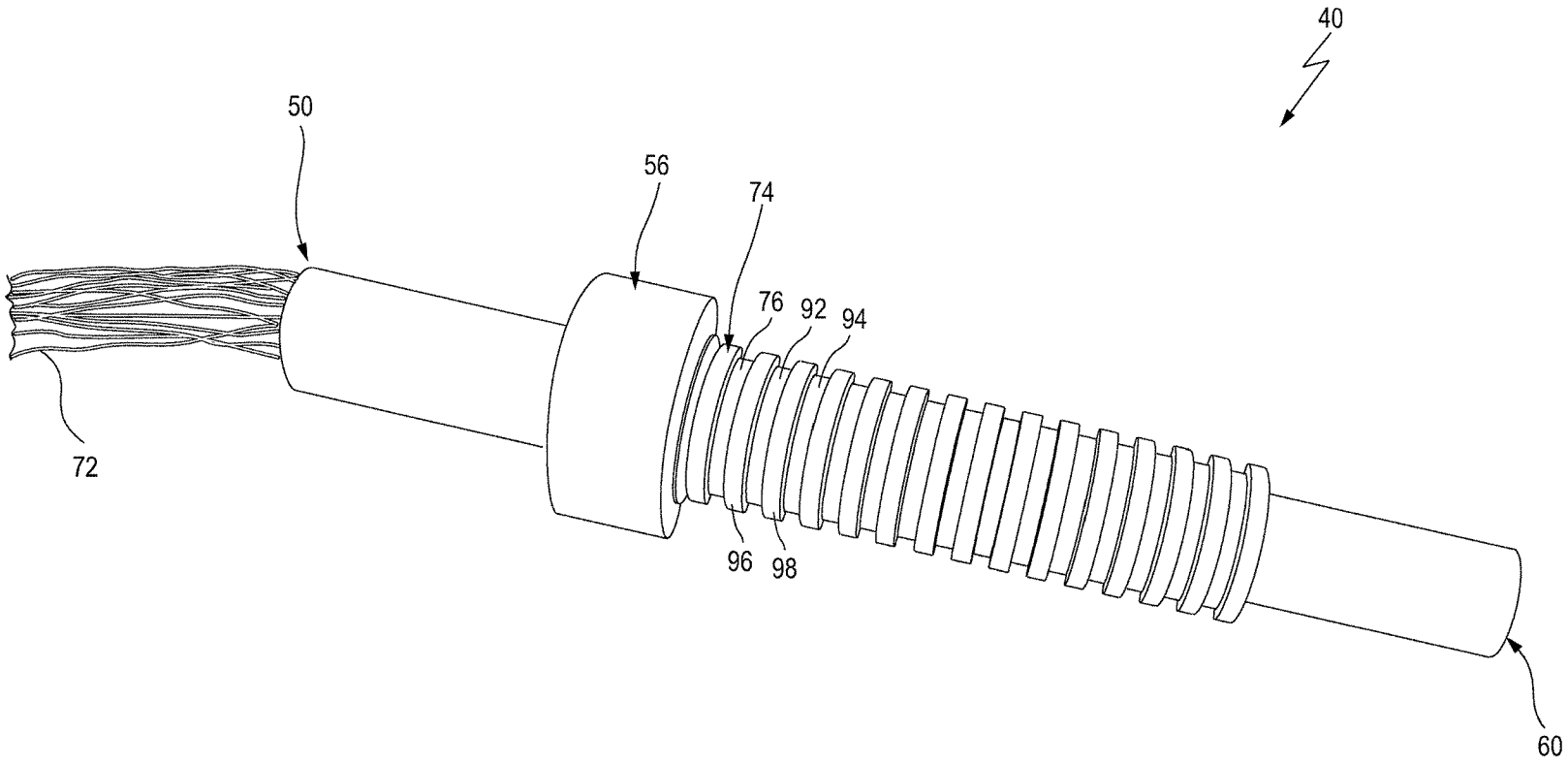
FIG. 4 shows an embodiment of a rotor arrangement.

FIG. 4 shows a fully assembled embodiment of the rotor arrangement 40. A total of fourteen contact rings, of which three, the contact rings 76, 92, 94, are provided with a reference symbol, are threaded onto the shaft element 48 illustrated in FIG. 3. The contact rings are threaded onto the middle section 64 alternately with insulating rings 74, 96, 98. In this way, said contact rings are electrically insulated from one another or from the flange 56. Said contact rings are insulated from the shaft element 48 radially on the inside by means of the insulation 58. In this way, fourteen cable elements 72 can be guided into the interior of the shaft element 48 and can be guided out at the first end 50 of said shaft element. A rotary coupling arrangement 10 for fourteen contacts can be provided in this way.

The interior of the shaft element 48 can be filled with an adhesive—in principle also the adhesive of the adhesive layer 59. The cutouts can also be filled with an adhesive. Fixing of the cable elements and strain relief can be provided in this way. As outlined above, the contact rings and the insulating rings can likewise be axially secured or fixed by means of a further adhesive bond on the adhesive layer 59.

The rotor arrangement 40 has a particularly large torsional stiffness on account of the continuous shaft element 48. In particular, the integral design and the material selection as steel alloy can also contribute to this. Bearing by means of the first end section in the coupling assembly 24 and by means of the second end section in the measuring system additionally allow arrangement of the rotor arrangement in the rotary coupling arrangement 10 without dedicated bearing. Hysteresis-free transmission of a rotary movement from a sensor interface 12 to the measuring system 20 given a compact design, in particular with a small outside diameter, is in this way possible. In this case, a free rotary movement n×360° for all fourteen contacts remains possible at the same time.

What is claimed is:

1. A rotor arrangement for a slip ring assembly, said rotor arrangement comprising a shaft element and at least one contact ring, wherein the shaft element is at least partially in the form of a hollow shaft with a hollow interior and a casing wall, wherein the shaft element has a middle section, wherein each contact ring is arranged on the shaft element in the middle section, wherein the middle section has at least one cutout through the casing wall into the interior, wherein each contact ring is connected to a cable element which is guided through one of the at least one cutout into the interior, and wherein the shaft element has a first end section with an outer circumferential cross section for a rotationally fixed coupling, wherein the middle section is offset in relation to the first end section by a flange, wherein the flange has an outside diameter which is larger than a smallest outside diameter of the first end section and larger than an outside diameter of the middle section, wherein a smallest outside diameter of the first end section is larger than an outside diameter of the middle section, wherein the outer circumferential cross section of the first end section is in the form of a profile cross section, wherein the shaft element is of integral design, wherein the rotor arrangement has more than one contact ring, wherein an insulating ring which electrically insulates adjacent contact rings from one another is arranged between two adjacent contact rings in each case, and wherein a further electrically insulating ring is arranged on the middle section adjacent the flange.

2. The rotor arrangement as claimed in claim 1, wherein the shaft element is formed from a material which has a shear modulus of greater than 75 GPa.

3. The rotor arrangement as claimed in claim 1, wherein each contact ring is electrically insulated from the shaft element by means of an insulation, wherein the at least one cutout is formed through the insulation and the casing wall into the interior.

4. The rotor arrangement as claimed in claim 1, wherein the shaft element is formed from an electrically insulating material.

5. The rotor arrangement as claimed in claim 1, wherein the shaft element is formed from a material which has a shear modulus of greater than 100 GPa.

6. The rotor arrangement as claimed in claim 3, wherein the insulation comprises a sleeve which is composed of an electrically insulating material and which is arranged on the middle section of the shaft element.

7. The rotor arrangement as claimed in claim 3, wherein the insulation comprises an adhesive layer, wherein the adhesive layer is provided by means of an adhesive which is composed of an electrically insulating material.

8. The rotor arrangement as claimed in claim 1, wherein the shaft element has a second end section which is opposite the first end section and in which the casing wall is fully closed.

9. A rotor arrangement for a slip ring assembly, comprising a shaft element and at least one contact ring, wherein the shaft element is at least partially in the form of a hollow shaft with a hollow interior and a casing wall, wherein the shaft element has a middle section, wherein each contact ring is arranged on the shaft element in the middle section, wherein the middle section has at least one cutout through the casing wall into the interior, wherein each contact ring is connected to a cable element which is guided through one of the at least one cutout into the interior, and wherein the shaft element has a first end section with an outer circumferential cross section for a rotationally fixed coupling, wherein each contact ring is electrically insulated from the shaft element by means of an insulation, wherein the at least one cutout is formed through the insulation and the casing wall into the interior, wherein the insulation comprises an adhesive layer, wherein the adhesive layer is provided by means of an adhesive which is composed of an electrically insulating material, and wherein each contact ring is adhesively bonded onto the middle section.

10. The rotor arrangement as claimed in claim 9, wherein respectively adjacent contact rings are arranged on the middle section in such a way that an air gap remains between said adjacent contact rings.

11. The rotor arrangement as claimed in claim 1, wherein each contact ring has a radial inner face, a radial outer face and two side faces, and wherein each contact ring is connected to a cable element by way of one of said two side faces.

12. The rotor arrangement as claimed in claim 1, wherein the rotor arrangement has at least fourteen contact rings.

13. The rotor arrangement as claimed in claim 1, wherein the rotor arrangement has a number of cutouts which corresponds to the number of contact rings.

14. The rotor arrangement as claimed in claim 1, wherein the rotor arrangement has at least one first cutout and one second cutout, wherein the first cutout and the second cutout are formed in the middle section such that they are offset in relation to one another in a circumferential direction.

15. A rotary coupling arrangement for a coordinate measuring device, comprising a slip ring assembly comprising a rotor arrangement for a slip ring assembly, comprising a shaft element and at least one contact ring, wherein the shaft element is at least partially in the form of a hollow shaft with a hollow interior and a casing wall, wherein the shaft element has a middle section, wherein each contact ring is arranged on the shaft element in the middle section, wherein the middle section has at least one cutout through the casing wall into the interior, wherein each contact ring is connected to a cable element which is guided through one of the at least one cutout into the interior, and wherein the shaft element has a first end section with an outer circumferential cross section for a rotationally fixed coupling, wherein the shaft element has a second end section which is opposite the first end section and in which the casing wall is fully closed, and wherein the rotary coupling arrangement further comprises a rotatable coupling assembly which has a first end and a second end which is opposite the first end, wherein the first end has a coupling interface, and wherein the second end has a slip ring assembly interface for rotationally fixed coupling to the first end section of the rotor arrangement, and comprising a rotation position measuring system for ascertaining a rotation position of the rotor arrangement of the slip ring assembly, and wherein the second end section is arranged on or in the rotation position measuring system.

16. A rotary coupling arrangement for a coordinate measuring device, comprising a slip ring assembly comprising a rotor arrangement for a slip ring assembly, comprising a shaft element and at least one contact ring, wherein the shaft element is at least partially in the form of a hollow shaft with a hollow interior and a casing wall, wherein the shaft element has a middle section, wherein each contact ring is arranged on the shaft element in the middle section, wherein the middle section has at least one cutout through the casing wall into the interior, wherein each contact ring is connected to a cable element which is guided through one of the at least one cutout into the interior, and wherein the shaft element has a first end section with an outer circumferential cross section for a rotationally fixed coupling, the rotary coupling arrangement further comprising a rotatable coupling assembly which has a first end and a second end which is opposite the first end, wherein the first end has a coupling interface, and wherein the second end has a slip ring assembly interface for rotationally fixed coupling to the first end section of the rotor arrangement, and comprising a rotation position measuring system for ascertaining a rotation position of the rotor arrangement of the slip ring assembly.

17. The rotary coupling arrangement as claimed in claim 16, wherein the rotary coupling arrangement has a drive device which is coupled to the coupling assembly in order to rotate the coupling assembly.

18. The rotary coupling arrangement as claimed in claim 16, wherein the shaft element has a second end section which is opposite the first end section and in which the casing wall is fully closed, and wherein the second end section is arranged on or in the rotation position measuring system.

* * * * *